US010415366B2

(12) United States Patent
Boone

(10) Patent No.: US 10,415,366 B2
(45) Date of Patent: Sep. 17, 2019

(54) RIG CONTROL APPARATUS, SYSTEM, AND METHOD

(71) Applicant: Nabors Drilling Technologies USA, Inc., Houston, TX (US)

(72) Inventor: Scott Gilbert Boone, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 15/834,829

(22) Filed: Dec. 7, 2017

(65) Prior Publication Data

US 2019/0178073 A1 Jun. 13, 2019

(51) Int. Cl.

| | |
|---|---|
| ***E21B 44/00*** | (2006.01) |
| *E21B 47/18* | (2012.01) |
| *E21B 7/04* | (2006.01) |
| *E21B 19/00* | (2006.01) |
| *E21B 45/00* | (2006.01) |
| *E21B 3/02* | (2006.01) |

(52) U.S. Cl.

CPC ..... *E21B 44/00* (2013.01); *E21B 3/02* (2013.01); *E21B 7/04* (2013.01); *E21B 19/008* (2013.01); *E21B 45/00* (2013.01); *E21B 47/18* (2013.01)

(58) Field of Classification Search

None

See application file for complete search history.

(56) References Cited

U.S. PATENT DOCUMENTS

2013/0066471 A1* 3/2013 Wang ..... G05B 13/00 700/275

* cited by examiner

*Primary Examiner* — Carlos R Ortiz Rodriguez

(74) *Attorney, Agent, or Firm* — Haynes and Boone, LLP

(57) ABSTRACT

A rig control system according to which an automated sequence engine includes a sequence template module configured to provide a template that includes a plurality of data fields outlining operational steps and associated parameters to perform a drilling process, and a recipe learning module configured to generate a recipe for entry into the data fields. The recipe learning module is configured to retrieve a data set related to a drilling rig's performance of the drilling process to drill a wellbore segment, and to score the data set based on a result of the drilling rig's performance of the drilling process and/or a characteristic of the wellbore segment. In some embodiments, the recipe learning module is further configured to categorize the data set based on a characteristic of the drilling rig and/or the wellbore segment. The recipe is based on the data set, the scoring, the categorizing, or any combination thereof.

21 Claims, 11 Drawing Sheets

116

| | | | |
|---|---|---|---|
| | Rotate-to-Slide Sequence Template | | |
| 144 | Slide Drill | | |
| | Raise to Height | | ft |
| | Toolface Advisory | | degrees |
| | Advisory Window | | degrees |
| | Slide Start Method? | | 1 or 2 |
| 146 | Method 1 | | |
| | Orient Off-Bottom Toolface | | degrees |
| | Lower To Distance Off Bottom | | ft |
| | WOB Maximum | | klbs |
| | DP Maximum | | psi |
| 148 | Method 2 | | |
| | Obtain Off-Bottom Toolface | | degrees |
| | Lower To Distance Off Bottom | | ft |
| | WOB Maximum | | klbs |
| | DP Maximum | | psi |
| | Rotate Reactive Torque | | degrees |
| 150 | Steering Profile | | |
| | Load Steering Tables | | |
| | Load Steering Configuration(s) | | |
| | Enabled | | yes/no |
| 152 | Oscillation Profile | | |
| | Load Oscillation Configuration(s) | | |
| | Enabled? | | yes/no |
| 154 | Start Auto-Driller #3 | | |
| | DP Enabled? | | yes/no |
| | DP Setpoint | | psi |
| | DP Filter | | |
| | DP Limit | | psi |
| | WOB Enabled? | | yes/no |
| | WOB Setpoint | | klbs |
| | WOB Filter | | |
| | ROP Setpoint | | ft/hr |
| | ROP Ramp of Setpoint | | |
| | Start Cruise Control? | | yes/no |
| | ROP Setpoint | | ft/hr |

Figure 8

RIG CONTROL APPARATUS, SYSTEM, AND METHOD

TECHNICAL FIELD

The present disclosure relates generally to oil and gas drilling and production operations, and, more particularly, to a rig control apparatus, system, and method.

BACKGROUND

At the outset of a drilling operation, drillers typically establish a drill plan that includes a steering objective location (or target location) and a drilling path to the steering objective location. Once drilling commences, the bottom-hole assembly (BHA) may be directed or "steered" from a vertical drilling path in any number of directions, to follow the proposed drill plan. For example, to recover an underground hydrocarbon deposit, a drill plan might include a vertical bore to the side of a reservoir containing a deposit, then a directional or horizontal bore that penetrates the deposit. The operator may then follow the plan by steering the BHA through the vertical and horizontal aspects in accordance with the plan.

In slide drilling implementations, such directional drilling requires accurate orientation of a bent housing of the down hole motor. The bent housing has a predetermined angle of bend. The high side of this bend is referred to as the toolface of the BHA. In such slide drilling implementations, rotating the drill string changes the orientation of the bent housing and the BHA, and thus the toolface. To effectively steer the assembly, the operator must first determine the current toolface orientation. Thereafter, if the drilling direction needs adjustment, the operator must rotate the drill string or alter other surface drilling parameters to change the toolface orientation.

In contrast to bent housing steerable motors, rotary steerable systems ("RSS") permit directional drilling to be conducted while the drill string is rotating. As the drill string rotates, frictional forces are reduced and more bit weight is typically available for drilling, which may support faster drilling rates than conventional bent housing drilling motors. In RSS implementations, the operator must make sure that the correct toolface is being maintained by the RSS. This may be achieved by sending instructions to the RSS while it is downhole.

Well operators rely upon experience and conventional best practices to create processes for carrying out tasks, such as drilling, in an efficient manner. However, more efficient, reliable, and intuitive methods for identifying efficient rig processes are needed.

BRIEF DESCRIPTION OF THE DRAWINGS

FIG. 8 illustrates an exemplary "screen shot" of the rotate-to-slide sequence template of FIG. 5, according to one or more embodiments of the present disclosure.

FIG. 11(*b*) is a flow diagram illustrating another step of the method of FIG. 10, according to one or more embodiments of the present disclosure.

DETAILED DESCRIPTION

Figure 1:
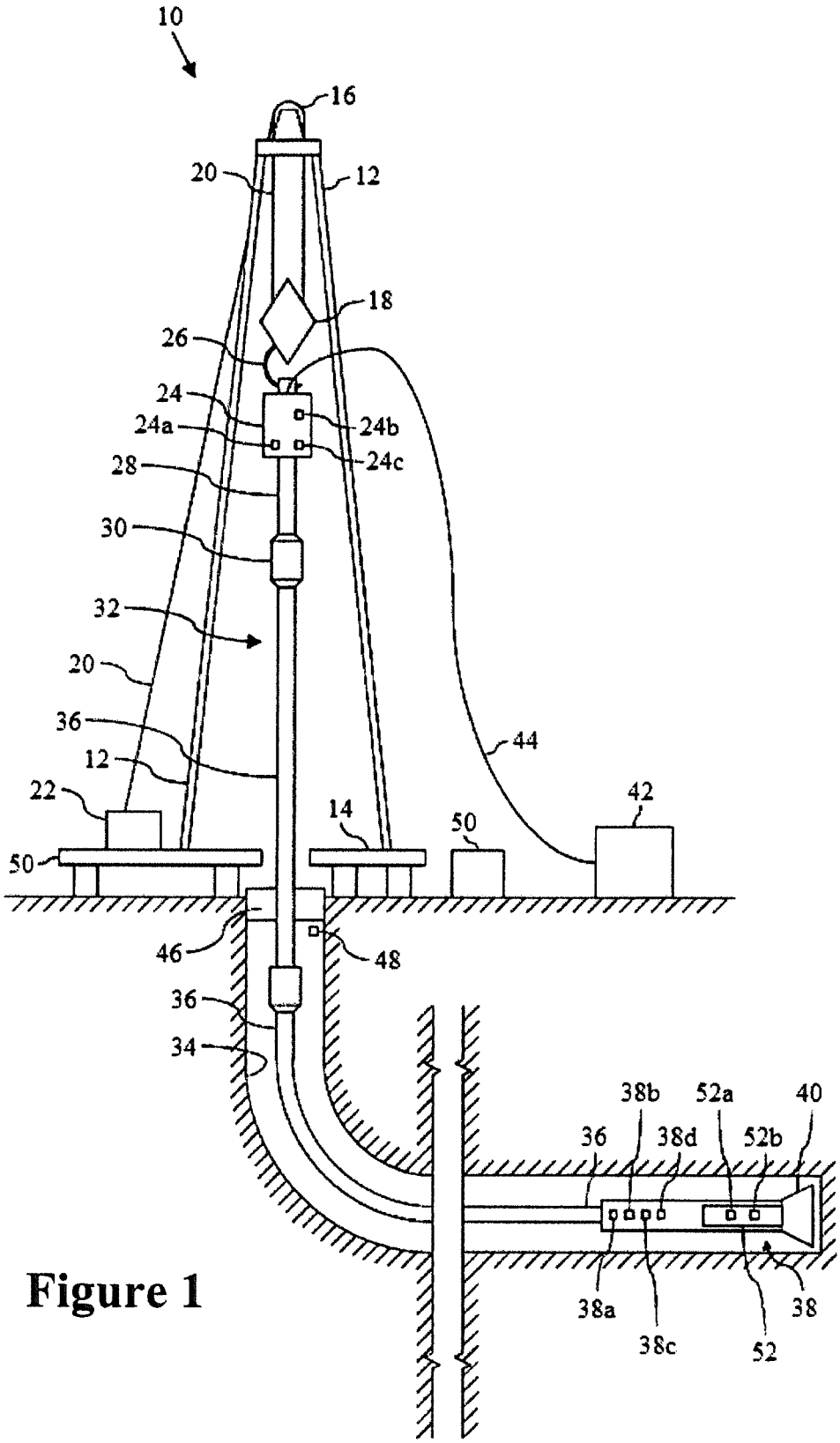
FIG. 1 is an elevational/schematic view of a drilling rig, according to one or more embodiments of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure is directed to a systematic approach for generating operational templates and recipe settings to drive the automation (and optimization) of a drilling process on a drilling rig. The drilling process may be directed based on best practices documented in well programs and/or through trial and error. In some implementations, historical time-series data may be utilized to identify the various setpoints and processes needed to execute the drilling process—this data may then be used to develop operational templates and/or recipe settings to automate (and optimize) the drilling rig's performance of the drilling process.

To begin with, the workflows of steps in the drilling process are analyzed to identify all of the operational setpoints and procedures required to complete the drilling process optimally—this information is then used to develop operational templates that outline the drilling process but still require the input of recipe settings to successfully carry out the drilling process. To develop such recipe settings, time-series data related to the drilling operation is collected from other drilling rigs and archived—specifically, data sets are collected from other drilling rigs to identify the various processes and setpoints used to accomplish the drilling process on such rigs. The data sets may be scored based upon the performance of the drilling process by each drilling rig versus the other drilling rigs (e.g., in the same area). The data sets may also be categorized based on, for example, rig type, geographic area, wellbore depth, etc. The data sets, the scoring of the data sets, and/or the categorization of the data sets enables the creation of recipe settings (i.e., for entry into the operational template) to automate (and optimize) the drilling rig's performance of the drilling process in accordance with best in class operations, as will be described in further detail below.

Referring to FIG. 1, an exemplary embodiment of such a drilling rig (i.e., on which the drilling process is automated and optimized) is schematically illustrated and generally referred to by the reference numeral 10. The drilling rig 10 is or includes a land-based drilling system—however, one or more aspects of the present disclosure are applicable or readily adaptable to any type of drilling rig (e.g., a jack-up rig, a semisubmersible, a drill ship, a coiled tubing rig, a well service rig adapted for drilling and/or re-entry operations, and a casing drilling rig, among others). The drilling rig 10 includes a mast 12 that supports lifting gear above a rig floor 14, which lifting gear includes a crown block 16 and a traveling block 18. The crown block 16 is coupled to the mast 12 at or near the top of the mast 12. The traveling block 18 hangs from the crown block 16 by a drilling line 20. The drilling line 20 extends at one end from the lifting gear to drawworks 22, which drawworks are configured to reel out and reel in the drilling line 20 to cause the traveling block 18 to be lowered and raised relative to the rig floor 14. The other end of the drilling line 20 (known as a dead line anchor) is anchored to a fixed position, possibly near the drawworks 22 (or elsewhere on the rig).

The drilling rig 10 further includes a top drive 24, a hook 26, a quill 28, a saver sub 30, and a drill string 32. The top drive 24 is suspended from the hook 26, which hook is attached to the bottom of the traveling block 18. The quill 28 extends from the top drive 24 and is attached to a saver sub 30, which saver sub is attached to the drill string 32. The drill string 32 is thus suspended within a wellbore 34. The quill 28 may instead be attached directly to the drill string 32. The term "quill" as used herein is not limited to a component which directly extends from the top drive 24, or which is otherwise conventionally referred to as a quill 28. For example, within the scope of the present disclosure, the "quill" may additionally (or alternatively) include a main shaft, a drive shaft, an output shaft, and/or another component which transfers torque, position, and/or rotation from the top drive 24 or other rotary driving element to the drill string 32, at least indirectly. Nonetheless, albeit merely for the sake of clarity and conciseness, these components may be collectively referred to herein as the "quill."

The drill string 32 includes interconnected sections of drill pipe 36, a bottom-hole assembly ("BHA") 38, and a drill bit 40. The BHA 38 may include stabilizers, drill collars, and/or measurement-while-drilling ("MWD") or wireline conveyed instruments, among other components. The drill bit 40 (also be referred to herein as a tool) is connected to the bottom of the BHA 38 or is otherwise attached to the drill string 32. One or more mud pumps 42 deliver drilling fluid to the drill string 32 through a hose or other conduit 44, which conduit may be connected to the top drive 24. The downhole MWD or wireline conveyed instruments may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 32, electronic transmission through a wireline or wired pipe, and/or transmission as electromagnetic pulses. The MWD tools and/or other portions of the BHA 38 may have the ability to store measurements for later retrieval via wireline and/or when the BHA 38 is tripped out of the wellbore 34.

The drilling rig 10 may also include a rotating blow-out preventer ("BOP") 46, such as if the wellbore 34 is being drilled utilizing under-balanced or managed-pressure drilling methods. In such an embodiment, the annulus mud and cuttings may be pressurized at the surface, with the actual desired flow and pressure possibly being controlled by a choke system, and the fluid and pressure being retained at the well head and directed down the flow line to the choke system by the rotating BOP 46. The drilling rig 10 may also include a surface casing annular pressure sensor 48 configured to detect the pressure in the annulus defined between, for example, the wellbore 34 (or casing therein) and the drill string 32. In the embodiment of FIG. 1, the top drive 24 is utilized to impart rotary motion to the drill string 32. However, aspects of the present disclosure are also applicable or readily adaptable to implementations utilizing other drive systems, such as a power swivel, a rotary table, a coiled tubing unit, a downhole motor, and/or a conventional rotary rig, among others.

The drilling rig 10 also includes a control system 50 configured to control or assist in the control of one or more components of the drilling rig 10—for example, the control system 50 may be configured to transmit operational control signals to the drawworks 22, the top drive 24, the BHA 38 and/or the mud pump(s) 42. The control system 50 may be a stand-alone component installed near the mast 12 and/or other components of the drilling rig 10. In some embodiments, the control system 50 includes one or more systems located in a control room proximate the drilling rig 10, such as the general purpose shelter often referred to as the "doghouse" serving as a combination tool shed, office, communications center, and general meeting place. The control system 50 may be configured to transmit the operational control signals to the drawworks 22, the top drive 24, the BHA 38, and/or the mud pump(s) 42 via wired or wireless transmission (not shown). The control system 50 may also be configured to receive electronic signals via wired or wireless transmission (also not shown) from a variety of sensors included in the drilling rig 10, where each sensor is configured to detect an operational characteristic or parameter. The sensors from which the control system 50 is configured to receive electronic signals via wired or wireless transmission (not shown) may include one or more of the following: a torque sensor 24*a*, a speed sensor 24*b*, a WOB sensor 24*c*, a downhole annular pressure sensor 38*a*, a shock/vibration sensor 38*b*, a toolface sensor 38*c*, a WOB sensor 38*d*, the surface casing annular pressure sensor 48, a mud motor delta pressure ("ΔP") sensor 52*a*, and one or more torque sensors 52*b*.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data. The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the drilling rig 10.

The drilling rig 10 may include any combination of the following: the torque sensor 24*a*, the speed sensor 24*b*, and the WOB sensor 24*c*. The torque sensor 24*a* is coupled to or otherwise associated with the top drive 24—however, the torque sensor 24*a* may alternatively be located in or associated with the BHA 38. The torque sensor 24*a* is configured to detect a value (or range) of the torsion of the quill 28 and/or the drill string 32 in response to, for example, operational forces acting on the drill string 32. The speed sensor 24*b* is configured to detect a value (or range) of the rotational speed of the quill 28. The WOB sensor 24*c* is coupled to or otherwise associated with the top drive 24, the drawworks 22, the crown block 16, the traveling block 18, the drilling line 20 (which includes the dead line anchor), or another component in the load path mechanisms of the drilling rig 10. More particularly, the WOB sensor 24*c* includes one or more sensors different from the WOB sensor 38*d* that detect and calculate weight-on-bit, which can vary from rig to rig (e.g., calculated from a hook load sensor based on active and static hook load).

Further, the drilling rig 10 may additionally (or alternatively) include any combination of the following: the downhole annular pressure sensor 38*a*, the shock/vibration sensor 38*b*, the toolface sensor 38*c*, and the WOB sensor 38*d*. The downhole annular pressure sensor 38*a* is coupled to or otherwise associated with the BHA 38, and may be configured to detect a pressure value or range in the annulus-shaped region defined between the external surface of the BHA 38 and the internal diameter of the wellbore 34 (also referred to as the casing pressure, downhole casing pressure, MWD casing pressure, or downhole annular pressure). Such measurements may include both static annular pressure (i.e., when the mud pump(s) 42 are off) and active annular pressure (i.e., when the mud pump(s) 42 are on). The shock/vibration sensor 38*b* is configured for detecting shock and/or vibration in the BHA 38. The toolface sensor 38*c* is configured to detect the current toolface orientation of the drill bit 40, and may be or include a magnetic toolface sensor which detects toolface orientation relative to magnetic north or true north. In addition, or instead, the toolface sensor 38*c* may be or include a gravity toolface sensor which detects toolface orientation relative to the Earth's gravitational field. In addition, or instead, the toolface sensor 38*c* may be or include a gyro sensor. The WOB sensor 38*d* may be integral to the BHA 38 and is configured to detect WOB at or near the BHA 38.

Finally, the drilling rig 10 may additionally (or alternatively) include any combination of the following: the mud motor ΔP sensor 52*a* and the torque sensor(s) 52*b*. The mud motor ΔP sensor 52*a* is configured to detect a pressure differential value or range across one or more motors 52 of the BHA 38 and may comprise one or more individual pressure sensors and/or a comparison tool. The motor(s) 52 may each be or include a positive displacement drilling motor that uses hydraulic power of the drilling fluid to drive the drill bit 40 (also known as a mud motor). The torque sensor(s) 52*b* may also be included in the BHA 38 for sending data to the control system 50 that is indicative of the torque applied to the drill bit 40 by the one or more motors 52.

Figure 2:
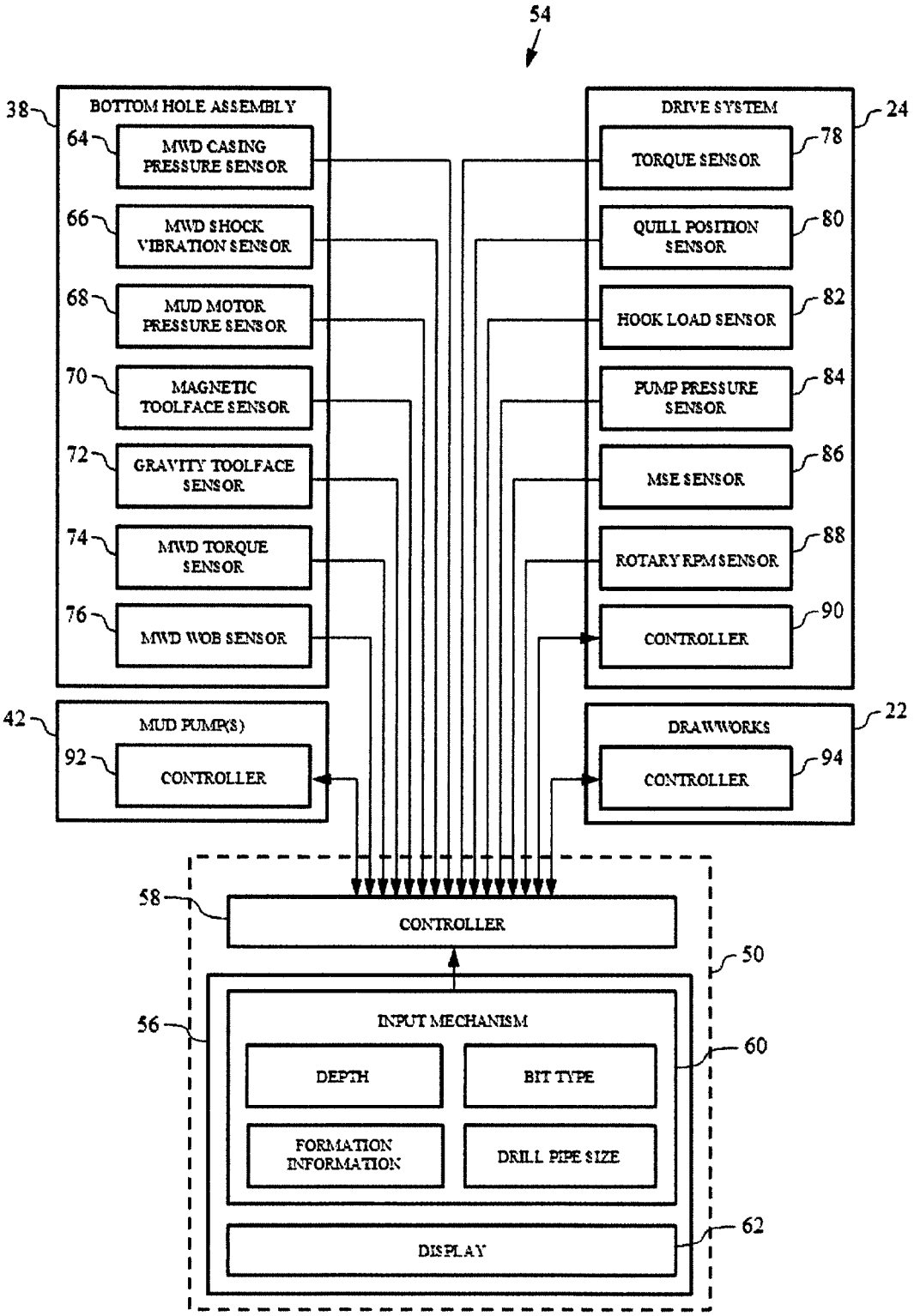
FIG. 2 is a diagrammatic illustration of an apparatus that may be implemented within the environment and/or the drilling rig of FIG. 1, according to one or more embodiments of the present disclosure.

Referring to FIG. 2, an apparatus is diagrammatically shown and generally referred to by the reference numeral 54. The apparatus 54 includes at least respective parts of the control system 50, the drawworks 22, the top drive 24 (identified as a "drive system"), the BHA 38, and the mud pump(s) 42. The apparatus 54 may be implemented within the environment and/or the drilling rig 10 of FIG. 1. The control system 50 includes a user-interface 56 and a controller 58—depending on the embodiment, these may be discrete components that are interconnected via a wired or wireless link. The user-interface 56 and the controller 58 may additionally (or alternatively) be integral components of a single system. The user-interface 56 may include an input mechanism 60 that permits a user to input drilling settings or parameters such as, for example, left and right oscillation revolution settings (these settings control the drive system to oscillate a portion of the drill string 32), acceleration, toolface setpoints, rotation settings, a torque target value (such as a previously calculated torque target value that may determine the limits of oscillation), information relating to the drilling parameters of the drill string 32 (such as BHA information or arrangement, drill pipe size, bit type, depth, and formation information), and/or other setpoints and input data.

The input mechanism 60 may include a keypad, voice-recognition apparatus, dial, button, switch, slide selector, toggle, joystick, mouse, database, and/or any other suitable data input device. The input mechanism 60 may support data input from local and/or remote locations. In addition, or instead, the input mechanism 60, when included, may permit user-selection of predetermined profiles, algorithms, setpoint values or ranges, such as via one or more drop-down menus—this data may instead (or in addition) be selected by the controller 58 via the execution of one or more database look-up procedures. In general, the input mechanism 60 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other suitable techniques or systems. The user-interface 56 may also include a display 62 for visually presenting information to the user in textual, graphic, or video form. The display 62 may be utilized by the user to input drilling parameters, limits, or setpoint data in conjunction with the input mechanism 60—for example, the input mechanism 60 may be integral to or otherwise communicably coupled with the display 62. The controller 58 may be configured to receive data or information from the user, the drawworks 22, the top drive 24, the BHA 38, and/or the mud pump(s) 42—the controller 58 processes such data or information to enable effective and efficient drilling.

The BHA 38 includes one or more sensors (typically a plurality of sensors) located and configured about the BHA 38 to detect parameters relating to the drilling environment, the condition and orientation of the BHA 38, and/or other information. For example, the BHA 38 may include an MWD casing pressure sensor 64, an MWD shock/vibration sensor 66, a mud motor ΔP sensor 68, a magnetic toolface sensor 70, a gravity toolface sensor 72, an MWD torque sensor 74, and an MWD weight-on-bit ("WOB") sensor 76—in some embodiments, one or more of these sensors is, includes, or is part of the following sensor(s) shown in FIG. 1: the downhole annular pressure sensor 38*a*, the shock/vibration sensor 38*b*, the toolface sensor 38*c*, the WOB sensor 38*d*, the mud motor ΔP sensor 52*a*, and/or the torque sensor(s) 52*b*.

The MWD casing pressure sensor 64 is configured to detect an annular pressure value or range at or near the MWD portion of the BHA 38. The MWD shock/vibration sensor 66 is configured to detect shock and/or vibration in the MWD portion of the BHA 38. The mud motor ΔP sensor 68 is configured to detect a pressure differential value or range across the mud motor of the BHA 38. The magnetic toolface sensor 70 and the gravity toolface sensor 72 are cooperatively configured to detect the current toolface. In some embodiments, the magnetic toolface sensor 70 is or includes a magnetic toolface sensor that detects toolface orientation relative to magnetic north or true north. In some embodiments, the gravity toolface sensor 72 is or includes a gravity toolface sensor that detects toolface orientation relative to the Earth's gravitational field. In some embodiments, the magnetic toolface sensor 70 detects the current toolface when the end of the wellbore 34 is less than about 7° from vertical, and the gravity toolface sensor 72 detects the current toolface when the end of the wellbore 34 is greater than about 7° from vertical. Other toolface sensors may also be utilized within the scope of the present disclosure that may be more or less precise (or have the same degree of precision), including non-magnetic toolface sensors and non-gravitational inclination sensors. The MWD torque sensor 74 is configured to detect a value or range of values for torque applied to the bit by the motor(s) of the BHA 38. The MWD weight-on-bit ("WOB") sensor 76 is configured to detect a value (or range of values) for WOB at or near the BHA 38.

The following data may be sent to the controller 58 via one or more signals, such as, for example, electronic signal via wired or wireless transmission, mud pulse telemetry, another signal, or any combination thereof: the casing pressure data detected by the MWD casing pressure sensor 64, the shock/vibration data detected by the MWD shock/vibration sensor 66, the pressure differential data detected by the mud motor ΔP sensor 68, the toolface orientation data detected by the toolface sensors 70 and 72, the torque data detected by the MWD torque sensor 74, and/or the WOB data detected by the MWD WOB sensor 76. The pressure differential data detected by the mud motor ΔP sensor 68 may alternatively (or additionally) be calculated, detected, or otherwise determined at the surface, such as by calculating the difference between the surface standpipe pressure just off-bottom and the pressure measured once the bit touches bottom and starts drilling and experiencing torque.

The top drive 24 includes one or more sensors (typically a plurality of sensors) located and configured about the top drive 24 to detect parameters relating to the condition and orientation of the drill string 32, and/or other information. For example, the top drive 24 may include a rotary torque sensor 78, a quill position sensor 80, a hook load sensor 82, a pump pressure sensor 84, a mechanical specific energy ("MSE") sensor 86, and a rotary RPM sensor 88—in some embodiments, one or more of these sensors is, includes, or is part of the following sensor shown in FIG. 1: the torque sensor 24*a*, the speed sensor 24*b*, the WOB sensor 24*c*, and/or the casing annular pressure sensor 48. The top drive 24 also includes a controller 90 for controlling the rotational position, speed, and direction of the quill 28 and/or another component of the drill string 32 coupled to the top drive 24—in some embodiments, the controller 90 is, includes, or is part of the controller 58.

The rotary torque sensor 78 is configured to detect a value (or range of values) for the reactive torsion of the quill 28 or the drill string 32. The quill position sensor 80 is configured to detect a value (or range of values) for the rotational position of the quill 28 (e.g., relative to true north or another stationary reference). The hook load sensor 82 is configured to detect the load on the hook 26 as it suspends the top drive 24 and the drill string 32. The pump pressure sensor 84 is configured to detect the pressure of the mud pump(s) 42 providing mud or otherwise powering the BHA 38 from the surface. The MSE sensor 86 is configured to detect the MSE representing the amount of energy required per unit volume of drilled rock—in some embodiments, the MSE is not directly detected, but is instead calculated at the controller 58 (or another controller) based on sensed data. The rotary RPM sensor 88 is configured to detect the rotary RPM of the drill string 32—this may be measured at the top drive 24 or elsewhere (e.g., at surface portion of the drill string 32). The following data may be sent to the controller 58 via one or more signals, such as, for example, electronic signal via wired or wireless transmission: the rotary torque data detected by the rotary torque sensor 78, the quill position data detected by the quill position sensor 80, the hook load data detected by the hook load sensor 82, the pump pressure data detected by the pump pressure sensor 84, the MSE data detected (or calculated) by the MSE sensor 86, and/or the RPM data detected by the RPM sensor 88.

The mud pump(s) 42 include a controller 92 and/or other means for controlling the pressure and flow rate of the drilling mud produced by the mud pump(s) 42—such control may include torque and speed control of the mud pump(s) 42 to manipulate the pressure and flow rate of the drilling mud and the ramp-up or ramp-down rates of the mud pump(s) 42. In some embodiments, the controller 92 is, includes, or is part of the controller 58.

The drawworks 22 include a controller 94 and/or other means for controlling feed-out and/or feed-in of the drilling line 20 (shown in FIG. 1)—such control may include rotational control of the drawworks to manipulate the height or position of the hook and the rate at which the hook ascends or descends. The drill string feed-off system of the drawworks 22 may instead be a hydraulic ram or rack and pinion type hoisting system rig, where the movement of the drill string 32 up and down is facilitated by something other than a drawworks. The drill string 32 may also take the form of coiled tubing, in which case the movement of the drill string 32 in and out of the wellbore 34 is controlled by an injector head which grips and pushes/pulls the tubing in/out of the wellbore 34. Such embodiments still include a version of the controller 94 configured to control feed-out and/or feed-in of the drill string 32. In some embodiments, the controller 94 is, includes, or is part of the controller 58.

The controller 58 is configured to receive data from the user-interface 56, the BHA 38, the top drive 24, the mud pump(s) 42, and/or the drawworks 22, as described above, and to utilize such information to enable effective and efficient drilling. The controller 58 may be further configured to generate a control signal, such as via intelligent adaptive control, and provide the control signal to the top drive 24, the mud pump(s) 42, and/or the drawworks 22 to adjust and/or maintain one or more of the following: the rotational position, speed, and direction of the quill 28 and/or another component of the drill string 32 coupled to the top drive 24, the pressure and flow rate of the drilling mud produced by the mud pump(s) 42, and the feed-out and/or feed-in of the drilling line 20. Moreover, the controller 90 of the top drive 24, the controller 92 of the mud pump(s) 42, and/or the controller 94 of the drawworks 22 may be configured to generate and transmit a signal to the controller 58—these signal(s) influence the control of the top drive 24, the mud pump(s) 42, and/or the drawworks 22. In addition, or instead, any one of the controllers 90, 92, and 94 may be configured to generate and transmit a signal to another one of the controllers 90, 92, or 94, whether directly or via the controller 58—as a result, any combination of the controllers 90, 92, and 94 may be configured to cooperate in controlling the top drive 24, the mud pump(s) 42, and/or the drawworks 22.

Figure 3:
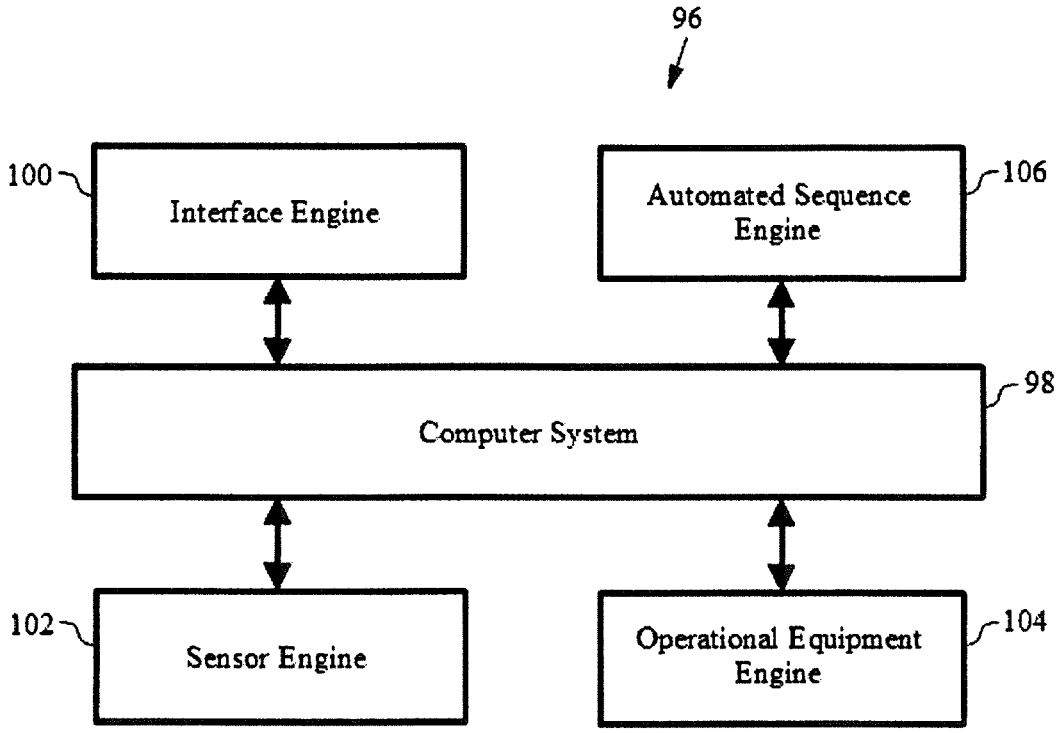
FIG. 3 is a diagrammatic illustration of a rig control system including a computer system, an interface engine, a sensor engine, an operational equipment engine, and an automated sequence engine, according to one or more embodiments of the present disclosure.

Referring to FIG. 3, a rig control system is diagrammatically illustrated and generally referred to by the reference numeral 96. The rig control system 96 may be, include, or be part of the following components, among others: the control system 50, the drawworks 22, the top drive 24, the BHA 38, and/or the mud pump(s) 42, or any combination thereof—for example, in some embodiments, the rig control system 96 includes a combination (or sub-combination) of the controllers 58, 90, 92, and 94. The rig control system 96 may be implemented within the environment and/or the drilling rig 10 of FIG. 1, and/or within the environment and/or the apparatus 54 of FIG. 2. The rig control system 96 includes a computer system 98 coupled to an interface engine 100, a sensor engine 102, an operational equipment engine 104, and an automated sequence engine 106. The term "engine" is meant herein to refer to an agent, instrument, or combination of either, or both, agents and instruments that may be associated to serve a purpose or accomplish a task—agents and instruments may include sensors, actuators, switches, relays, valves, power plants, system wiring, equipment linkages, specialized operational equipment, computers, components of computers, programmable logic devices, microprocessors, software, software routines, software modules, communication equipment, networks, network services, and/or other elements and their equivalents that contribute to the purpose or task to be accomplished by the engine. Accordingly, some of the engines may be software modules or routines, while others of the engines may be hardware elements in communication with the computer system 98. The computer system 98 operates to control the interaction of data with and between the other components of the rig control system 96.

The interface engine 100 includes at least one input and output device or system that enables a user to interact with the computer system 98 and the functions that the computer system 98 provides—in some embodiments, the interface engine 100 includes the following component, among others: the user-interface 56 (shown in FIG. 2). The interface engine 100 may have multiple user stations, which may include a video display, a keyboard, a pointing device, a document scanning/recognition device, or other device configured to receive an input from an external source, which may be connected to a software process operating as part of a computer or local area network. The interface engine 100 may include externally positioned equipment configured to input data into the computer system 98. Data entry may be accomplished through various forms, including raw data entry, data transfer, or document scanning coupled with a character recognition process, for example. The interface engine 100 may include a user station that has a display with touch-screen functionality, so that a user may receive information from the rig control system 96, and provide input to the rig control system 96 directly via the display or touch screen. Other examples of sub-components that may be part of an interface engine 100 include, but are not limited to, audible alarms, visual alerts, telecommunications equipment, and computer-related components, peripherals, and systems. Sub-components of the interface engine 100 may be positioned in various locations within an area of operation, such as on a drilling rig at a drill site. Sub-components of the interface engine 100 may also be remotely located away from the general area of operation, for example, at a business office, at a sub-contractor's office, in an operations manager's mobile phone, and in a sub-contractor's communication linked personal data appliance. A wide variety of technologies would be suitable for providing coupling of various sub-components of the interface engine 100 and the interface engine 100 itself to the computer system 98. In some embodiments, the operator may thus be remote from the interface engine 100, such as through a wireless or wired internet connection, or a portion of the interface engine 100 may be remote from the rig, or even the wellsite, and be proximate a remote operator, and the portion thus connected through, e.g., an internet connection, to the remainder of the on-site components of the interface engine 100.

The sensor engine 102 may include devices such as sensors, meters, detectors, or other devices configured to measure or sense a parameter related to a component of a well drilling operation—in some embodiments, the sensor engine 102 includes one or more of the following components (shown in FIGS. 1 and 2), among others: the torque sensor 24*a*, the speed sensor 24*b*, the WOB sensor 24*c*, the downhole annular pressure sensor 38*a*, the shock/vibration sensor 38*b*, the toolface sensor 38*c*, the WOB sensor 38*d*, the surface casing annular pressure sensor 48, the mud motor ΔP sensor 52*a*, the torque sensor(s) 52*b*, the MWD casing pressure sensor 64, the MWD shock/vibration sensor 66, the mud motor ΔP sensor 68, the magnetic toolface sensor 70, the gravity toolface sensor 72, the MWD torque sensor 74, the MWD WOB sensor 76, the rotary torque sensor 78, the quill position sensor 80, the hook load sensor 82, the pump pressure sensor 84, the MSE sensor 86, and the rotary RPM sensor 88. The sensors or other detection devices are generally configured to sense or detect activity, conditions, and circumstances in an area to which the device has access. These sensors may be located on the surface or downhole, and configured to transmit information to the surface through a variety of methods. Sub-components of the sensor engine 102 may be deployed at any operational area where information on the execution of one or more drilling operations may occur. Readings from the sensor engine 102 are fed back to the computer system 98. The reported data may include the sensed data, or may be derived, calculated, or inferred from sensed data. Sensed data may be that concurrently collected, recently collected, or historically collected, at that wellsite or an adjacent wellsite. The computer system 98 may send signals to the sensor engine 102 to adjust the calibration or operational parameters in accordance with a control program in the computer system 98, which control program is generally based upon the objectives set forth in the wellplan. Additionally, the computer system 98 may generate outputs that control the well drilling operation, as described in further detail below. The computer system 98 receives and processes data from the sensor engine 102 or from other suitable source(s), and monitors the rig and conditions on the rig based on the received data.

The operational equipment engine 104 may include a plurality of devices configured to facilitate accomplishment of the objectives set forth in the wellplan—in some embodiments, the operational equipment engine 104 includes one or more components of FIG. 1's drilling rig 10 and/or FIG. 2's apparatus 54. For example, the operational equipment engine 104 may include the drawworks 22, the top drive 24, the BHA 38, the mud pump(s) 42, and/or the control system 50. The objective of the operational equipment engine 104 is to drill a well in accordance with the specifications set forth in the wellplan. Therefore, the operational equipment engine 104 may include hydraulic rams, rotary drives, valves, solenoids, agitators, drives for motors and pumps, control systems, and any other tools, machines, equipment, etc. that would be required to drill the well in accordance with the wellplan. The operational equipment engine 104 may be designed to exchange communication with computer system 98, so as to not only receive instructions, but to provide information on the operation of the operational equipment engine 104 apart from any associated sensor engine 102. For example, encoders associated with the top drive 24 may provide rotational information regarding the drill string 32, and hydraulic links may provide height, positional information, or a change in height or positional information. The operational equipment engine 104 may be configured to receive control inputs from the computer system 98 and to control the well drilling operation (i.e., the components conducting the well drilling operation) in accordance with the received inputs from the computer system 98.

The computer system 98, interface engine 100, sensor engine 102, and operational equipment engine 104 should be fully integrated with the wellplan to assure proper operation and safety. Moreover, measurements of the rig operating parameters (block position, hook load, pump pressure, slips set, etc.) should have a high level of accuracy to enable proper accomplishment of the wellplan with minimal or no human intervention once the operational parameters are selected and the control limits are set for a given drilling operation, and the trigger(s) are pre-set to initiate the operation.

Figure 4:
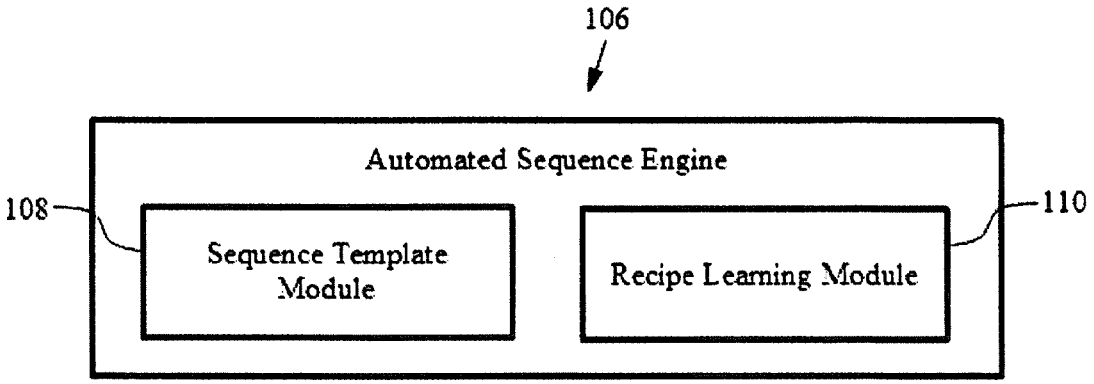
FIG. 4 is a diagrammatic illustration of the automated sequence engine of FIG. 3, the automated sequence engine including a sequence template module and a recipe learning module, according to one or more embodiments of the present disclosure.

Referring to FIG. 4, an embodiment of the automated sequence engine 106 is schematically illustrated—in the embodiment shown, the automated sequence engine 106 includes a sequence template module 108 and a recipe learning module 110. The sequence template module 108 and the recipe learning module 110, in combination, are configured to automate the process of "drilling a stand down" in accordance with the wellplan. Generally, the process of "drilling a stand down" begins when the stand connection is made up and ends when the stand has been drilled and set back in slips at connection height. More particularly, the process of "drilling a stand down" may be divided into a series of tasks, which may include one or more of the following, among others: making up the stand connection, transitioning from slips-to-weight, initiating rotary drilling, transitioning from rotary drilling to slide drilling (i.e., when steering is required), transitioning from slide drilling to rotary drilling (i.e., when steering is no longer required), drilling the stand to completion, reaming the drilled hole section, and setting the stand in slips at connection height. To enable effective and efficient drilling in accordance with the wellplan, various combinations of these tasks may be carried out in different ways for each stand (or portion thereof) in the drill string 32. To this end, the sequence template module 108 includes sequence template(s) that may be completed in advance to facilitate the automation of these tasks—such sequence template(s) may include a variety of operational steps and associated parameters for which setpoints and/or operational limits are needed to accomplish a specific task.

Figure 5:
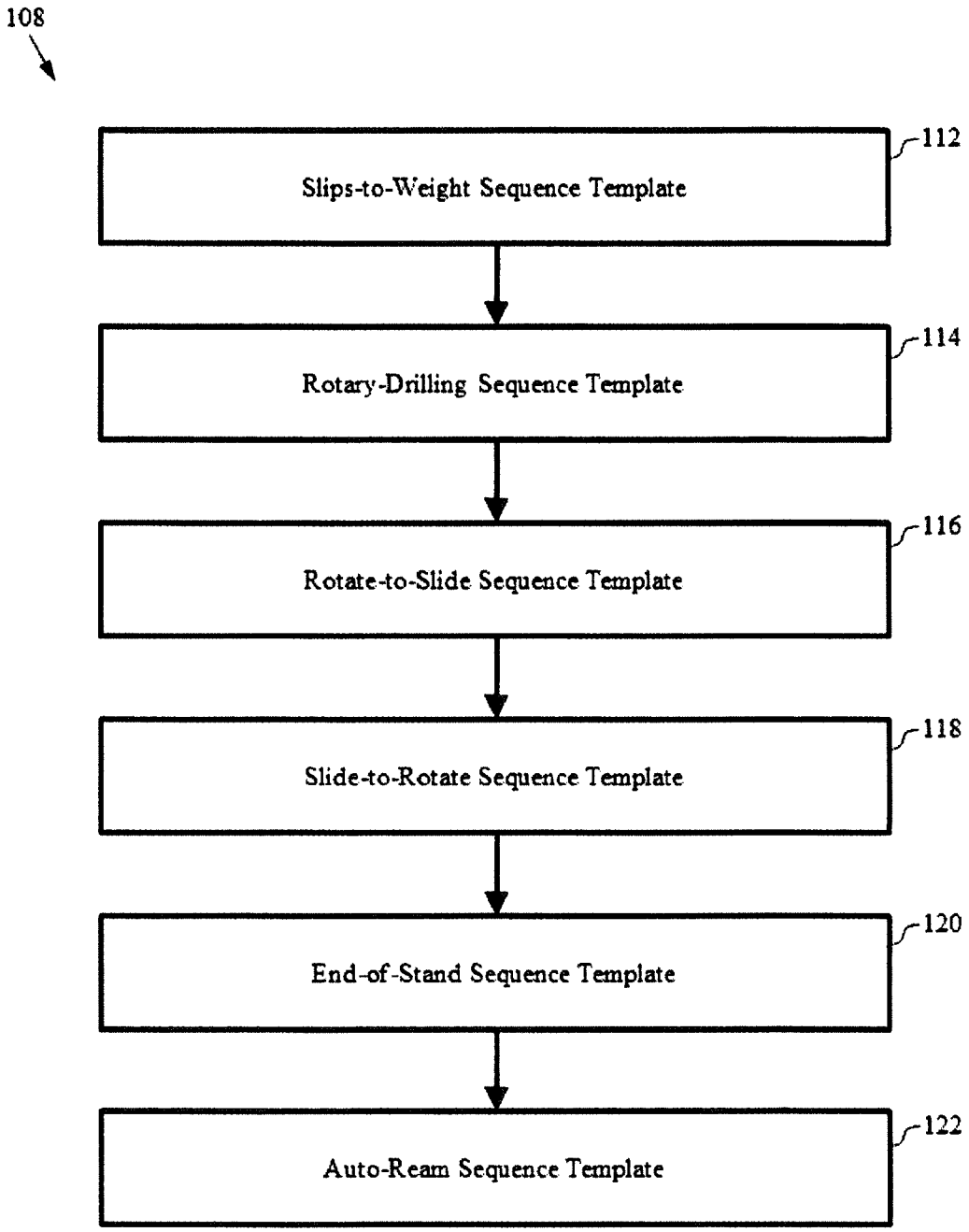
FIG. 5 is a flow diagram illustrating the sequence template module of FIG. 4, the sequence template module including a slips-to-weight sequence template, a rotary-drilling sequence template, a rotate-to-slide sequence template, a slide-to-rotate sequence template, an end-of-stand sequence template, and an auto-ream sequence template, according to one or more embodiments of the present disclosure.

Referring to FIG. 5, in an embodiment, the sequence template module 108 includes a slips-to-weight sequence template 112, a rotary-drilling sequence template 114, a rotate-to-slide sequence template 116, a slide-to-rotate sequence template 118, an end-of-stand sequence template 120, and an auto-ream sequence template 122. The appropriate sequence template(s) can be activated when a particular hole section is reached (e.g., surface hole, intermediate hole, or production hole), or when a certain predefined event occurs (e.g., circulate a kick or trip out of hole to change a bit)—in some embodiments, one or more of these sequence template(s) can be activated by the rig control system 96 after it receives sensed information indicating that the predefined event has occurred or the condition exists. The various sequence template(s) provide a framework for completing the process of "drilling a stand down," but require the input of specific combinations of setpoints and/or control limits (referred to herein as "recipes") before the process can be carried out—embodiments of these sequence template(s) are described in further detail below. The recipes may be specific to a particular hole section (e.g., the surface hole, the intermediate hole, or the production hole), a complex or specific geological layer through which the drilling is expected to proceed, and/or another characteristic of the well. In addition, or instead, the recipes may set the control limits of the drilling rig and can include sign-off, dates and times of creation, and dates and times of implementing, within the rig control system 96 (or another control system). The recipes will be described in further detail below in connection with the recipe learning module 110.

Figure 6:
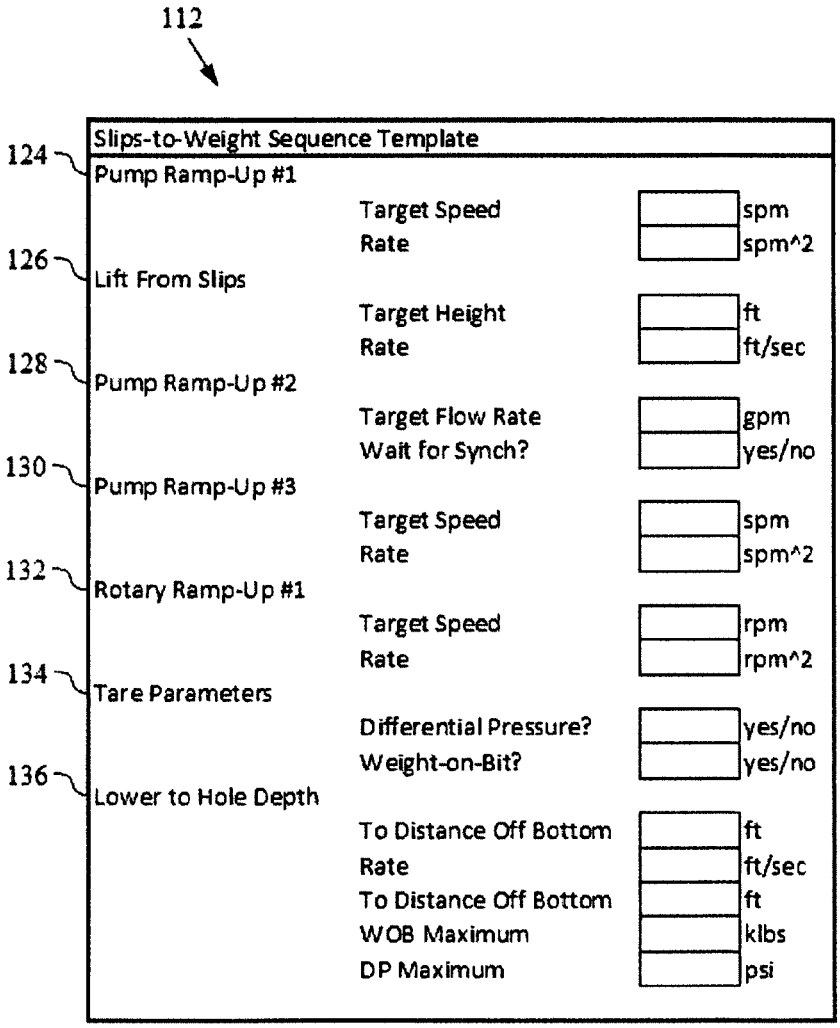
FIG. 6 illustrates an exemplary "screen shot" of the slips-to-weight sequence template of FIG. 5, according to one or more embodiments of the present disclosure.

Referring to FIG. 6, an embodiment of the slips-to-weight sequence template 112 is illustrated—in the process of "drilling a stand down," this sequence template facilitates the task of transitioning from slips-to-weight. In the embodiment shown, the slips-to-weight sequence template 112 includes a first pump ramp-up at 124, lifting the stand and/or the drill string 32 from slips at 126, a second pump ramp-up at 128, a third pump ramp-up at 130, a first rotary ramp-up at 132, zeroing parameters at 134, and lowering the BHA 38 to hole depth at 136. The first pump ramp-up 124 facilitates the starting and ramping up of the mud pump(s) 42 according to a predetermined schedule, and includes data fields for target speed (in strokes-per-minute or "spm") and rate (in spm^2). The lifting of the drill string 32 from slips at 126 facilitates the disengagement of the slips from the drill string 32 so as to enable subsequent lowering of the stand, and includes data fields for target height (in feet or "ft") and rate (in feet-per-second or "ft/sec"). The second pump ramp-up 128 facilitates further ramping up of the mud pump(s) 42, and includes a data field for target flow rate (in gallons-per-minute or "gpm"), and a data field for selecting whether or not to wait for a communications synch (e.g., via mud pulse telemetry) from the BHA 38 before continuing to the third pump ramp-up 130. The third pump ramp-up 130 facilitates even further ramping up of the mud pump(s) 42, and includes data fields for target speed (in spm) and rate (in spm^2). The first rotary ramp-up 132 facilitates the starting and ramping up of the top drive 24, and includes data fields for target speed (in revolutions-per-minute or "RPM") and rate (in RPM^2). The zeroing of parameters at 134 includes a data field for selecting whether or not to tare the differential pressure and/or the weight-on-bit before lowering the drill string 32 to hole depth. The lowering the BHA 38 to hole depth at 136 facilitates the feed-out of the drilling line 20 by the drawworks 22, and includes data fields for the following parameters and/or control limits: a first distance off bottom (in ft) to which the BHA 38 is to be lowered, the rate (in ft/sec) at which the BHA 38 is to be lowered to the first distance off bottom, a second distance off bottom (in ft) to which the BHA 38 is to be lowered, a maximum weight-on-bit (in kilopounds or "klbs") at which the BHA 38 is to be lowered to the second distance off bottom, and a maximum differential pressure at which the BHA 38 is to be lowered to the second distance off bottom.

Figure 7:
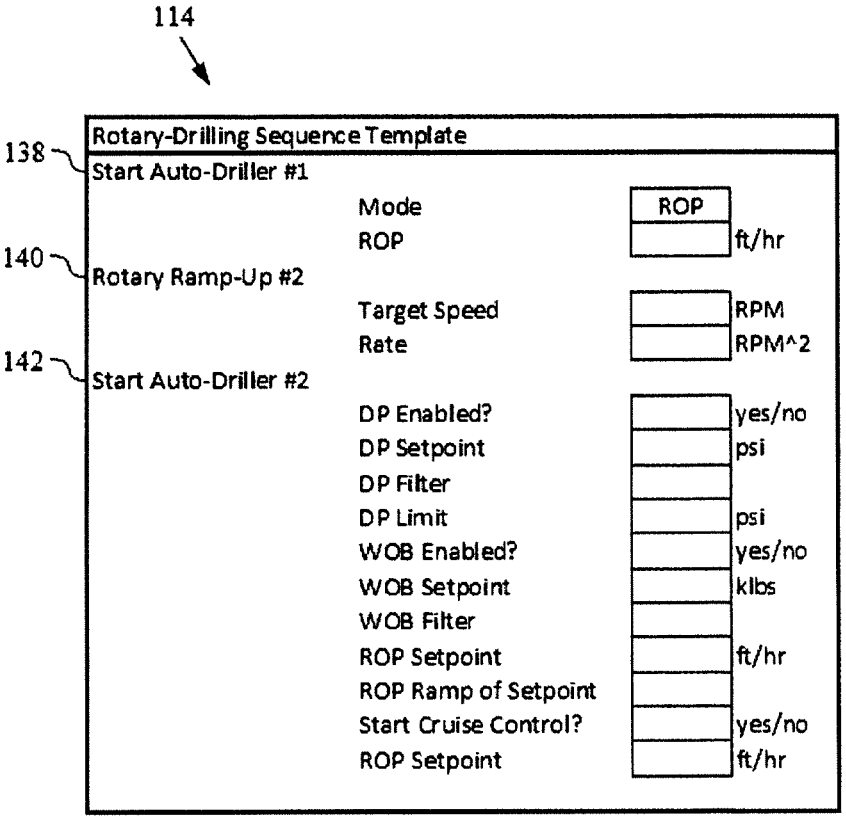
FIG. 7 illustrates an exemplary "screen shot" of the rotary-drilling sequence template of FIG. 5, according to one or more embodiments of the present disclosure.

Referring to FIG. 7, an embodiment of the rotary-drilling sequence template 114 is illustrated—in the process of "drilling a stand down," this sequence template facilitates the task of rotary drilling. In the embodiment shown, the rotary-drilling sequence template 114 includes a first auto-drilling process at 138, a second rotary ramp-up at 140, and a second auto-drilling process at 142. The first auto-drilling process 138 facilitates further feed-out of the drilling line 20 by the drawworks 22, and includes data fields for mode (in this case rate-of progression or "ROP" mode) and ROP (in feet-per-hour or "ft/hr"). The second rotary ramp-up 140 facilitates the further ramping up of the top drive 24, and includes data fields for target speed (in RPM) and rate (in RPM^2). The second auto-drilling process 142 facilitates the monitoring and control of differential pressure, weight-on-bit, and rate-of-progression during the rotary drilling task, and includes data fields for the following parameters and/or control limits: selecting whether or not to enable the monitoring and control of differential pressure, a differential pressure setpoint (in pounds-per-square inch or "psi"), a differential pressure filter, a differential pressure limit (in psi), selecting whether or not to enable the monitoring and control of weight-on-bit, a weight-on-bit setpoint (in klbs), a weight-on-bit filter, a rate-of-progression setpoint (in ft/hr), a rate-of-progression ramp of setpoint, selecting whether or not to start cruise control, and an ROP setpoint for cruise control (in ft/hr).

Referring to FIG. 8, an embodiment of the rotate-to-slide sequence template 116 is illustrated—in the process of "drilling a stand down," this sequence template facilitates the task of transitioning from rotary drilling to slide drilling in order to steer the BHA 38. In the embodiment shown, the rotate-to-slide sequence template 116 includes initiating a slide drilling process at 144, a first slide start method at 146, a second slide start method at 148, a steering profile at 150, an oscillation profile at 152, and a third auto-drilling process at 154. The initiating of the slide drilling process at 144 facilitates the setting of control limits within which the toolface orientation must remain, and includes data fields for a height to which the drill string 32 is to be raised (in ft) before initiating the slide, a toolface advisory (in degrees; determining the target orientation of the BHA 38), an advisory window (in degrees; setting a tolerance within which the orientation of the BHA 38 must remain), and selecting the slide start method. The first slide start method 146 includes data fields for orienting the off-bottom toolface (in degrees), lowering the BHA 38 to a distance off bottom (in ft), setting a maximum limit for the weight-on-bit (in klbs), and setting a maximum limit for the differential pressure (in psi). The second slide start method 148 includes data fields for obtaining the off-bottom toolface (in degrees), lowering the BHA 38 to a distance off bottom (in ft), setting a maximum limit for the weight-on-bit (in klbs), setting a maximum limit for the differential pressure (in psi), and rotating the drill string 32 (in degrees) to account for reactive torque imparted by the drill bit. The steering profile 150 facilitates directional drilling of the wellbore 34 using the top drive 24 and the BHA 38, and includes data fields for load steering table(s), load steering configuration(s), and selecting whether or not the steering profile is enabled. The oscillation profile 152 facilitates the oscillation of the drill string 32 by the top drive 24 to reduce frictional forces between the drill string 32 and the wellbore 34, and includes data fields for load oscillation configuration(s), and selecting whether or not the oscillation profile is enabled. The third auto-drilling process 154 facilitates the monitoring and control of differential pressure, weight-on-bit, and rate-of-progression during the slide drilling task, and includes data fields substantially identical to the data fields for the second auto-drilling process 142.

Figure 9:
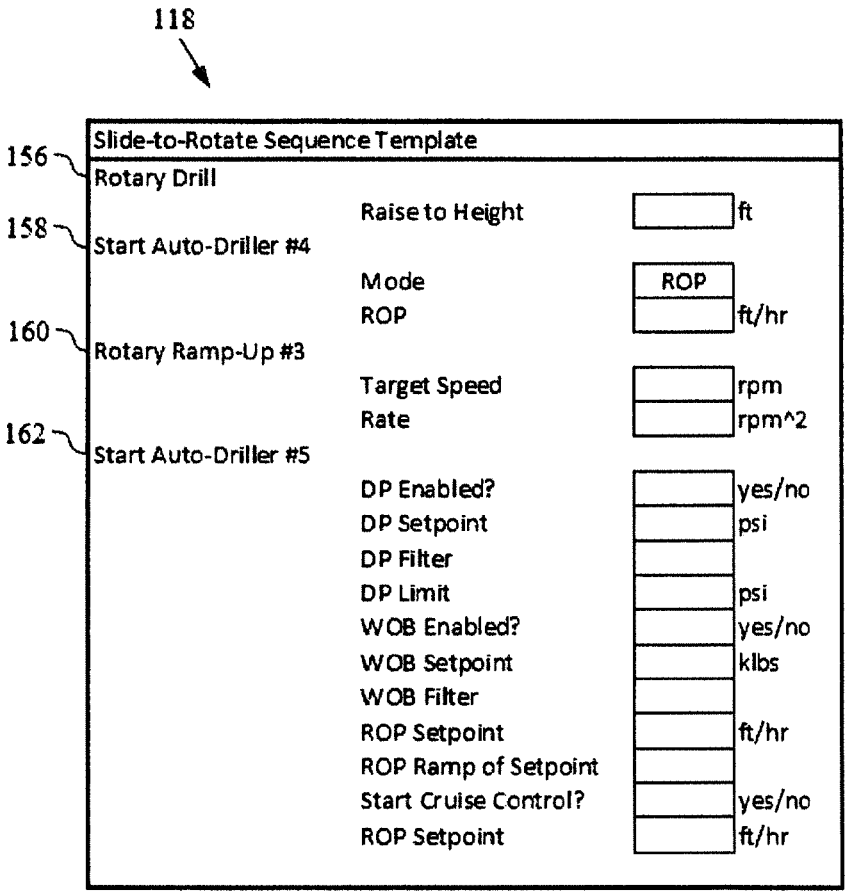
FIG. 9 illustrates an exemplary "screen shot" of the slide-to-rotate sequence template of FIG. 5, according to one or more embodiments of the present disclosure.

Referring to FIG. 9, an embodiment of the slide-to-rotate sequence template 118 is illustrated—in the process of "drilling a stand down," this sequence template facilitates the task of transitioning from slide drilling to rotary drilling. In the embodiment shown, the slide-to-rotate sequence template 118 includes initiating a rotary drilling process at 156, a fourth auto-drilling process at 158, a third rotary ramp-up at 160, and a fifth auto-drilling process at 162. The initiating of the rotary drilling process at 156 includes a data field for a height to which the drill string 32 is to be raised (in ft) before initiating rotation of the drill string 32. The fourth auto-drilling process 158 facilitates feed-out of the drilling line 20 by the drawworks 22, and includes data fields for mode (in this case ROP mode) and ROP (in ft/hr). The third rotary ramp-up 160 facilitates the starting (or re-starting) and ramping up of the top drive 24, and includes data fields for target speed (in RPM) and rate (in RPM^2). The fifth auto-drilling process 162 facilitates the monitoring and control of differential pressure, weight-on-bit, and rate-of-progression during the slide drilling task, and includes data fields substantially identical to the data fields for the second auto-drilling process 142 and the third auto-drilling process 154.

Turning back to FIG. 5, the end-of-stand sequence template 120 and the auto-ream sequence template 122 may be configured in a manner that is substantially similar to that described above in connection with the slips-to-weight sequence template 112, the rotary-drilling sequence template 114, the rotate-to-slide sequence template 116, and/or the slide-to-rotate sequence template 118—therefore, the end-of-stand sequence template 120 and the auto-ream sequence template 122 will not be described in further detail. In combination, the sequence template(s) described above at least partially facilitate the automation of tasks in the process of "drilling a stand down"—specifically, the sequence template(s) provide a framework for completing the process but require the input of specific recipes into the above-described data fields before the process can be successfully carried out. The selection of appropriate recipes for entry into the various data fields of the sequence template(s) may be determined (at least in part) by rig personnel or others involved in the drilling operation.

The recipe learning module 110 may alternatively (or additionally) generate the setpoints and/or control limits (i.e., recipes) needed to automate (and optimize) the process of "drilling a stand down"—such automation is produced by automatically entering or otherwise communicating (e.g., using the computer system 98) these recipes into the data fields of the sequence template(s) described above. To generate the recipe(s), the recipe learning module 110 is configured to retrieve a data set related to a drilling rig's performance of the drilling process (e.g., the process for "drilling a stand down") to drill a wellbore segment, and to score the data set based on a result of the drilling rig's performance of the drilling process and/or a characteristic of the wellbore segment. In some embodiments, the recipe is based on the data set and the scoring of the data set. In some embodiments, to generate the recipe, the recipe learning module 110 is also configured to categorize the data set based on a characteristic of the drilling rig and/or the wellbore segment—in such embodiments, the recipe is further based on the categorizing of the data set. The characteristic of the drilling rig and/or the wellbore segment that forms the basis on which the data set is categorized may include at least one of: a depth of the wellbore segment, a geological layer through which the wellbore segment extends, a geographic location of the drilling rig, or a rig type of the drilling rig.

Figure 10:
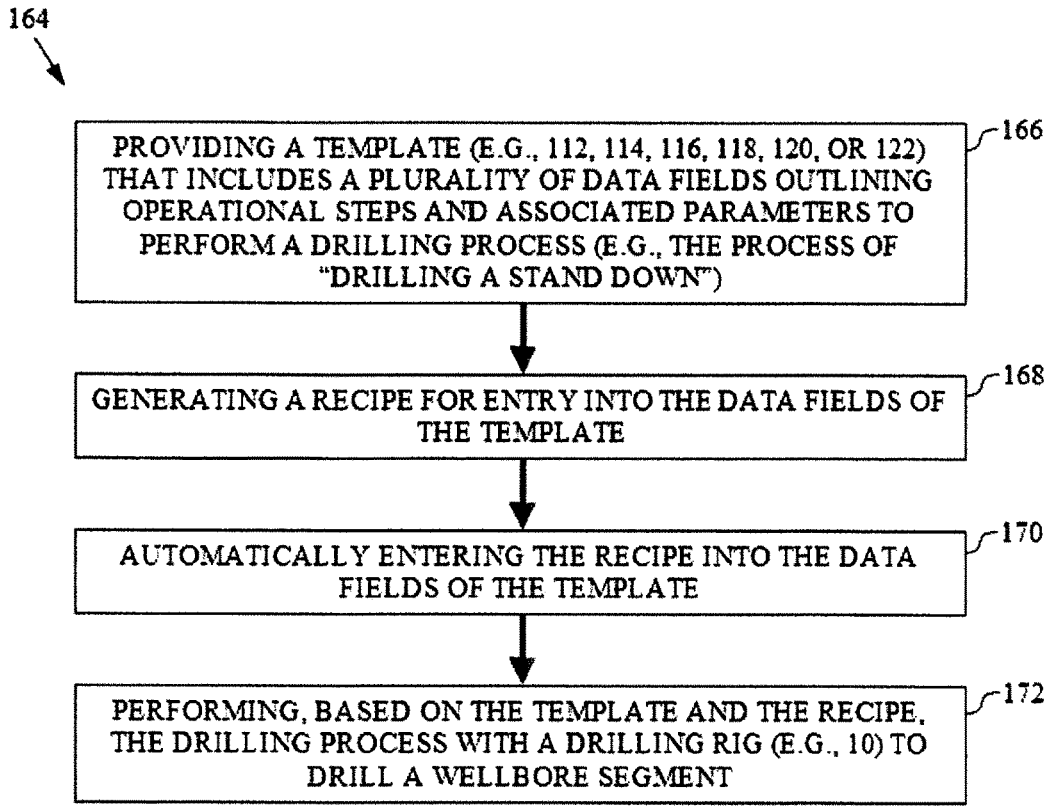
FIG. 10 is a flow diagram of a method for implementing one or more embodiments of the present disclosure.

Referring to FIG. 10, a method is diagrammatically illustrated and generally referred to by the reference numeral 164. In an embodiment, the method 164 includes providing a template (e.g., 112, 114, 116, 118, 120, or 122) that includes a plurality of data fields outlining operational steps and associated parameters to perform a drilling process (e.g., the process of "drilling a stand down") at a step 166, generating a recipe for entry into the data fields of the template at a step 168, automatically entering the recipe into the data fields of the template at a step 170, and performing, based on the template and the recipe, the drilling process with a drilling rig (e.g., 10) to drill a wellbore segment at a step 172. In some embodiments, the wellbore segment and the another wellbore segment are part of the same wellbore and the drilling rig and the another drilling rigs are the same drilling rig. In other embodiments, the wellbore segment and the another wellbore segment are part of different wellbores and the drilling rig and the another drilling rigs are different drilling rigs. In some embodiments, the sequence template module 108 of the automated sequence engine 106 is configured to execute the step 166. In some embodiments, the recipe learning module 110 of the automated sequence engine 106 is configured to execute the step 168. In some embodiments, the computer system 98 is configured to perform the step 170. In some embodiments, the operational equipment engine 104 is configured to perform the step 172.

Figure 11A:
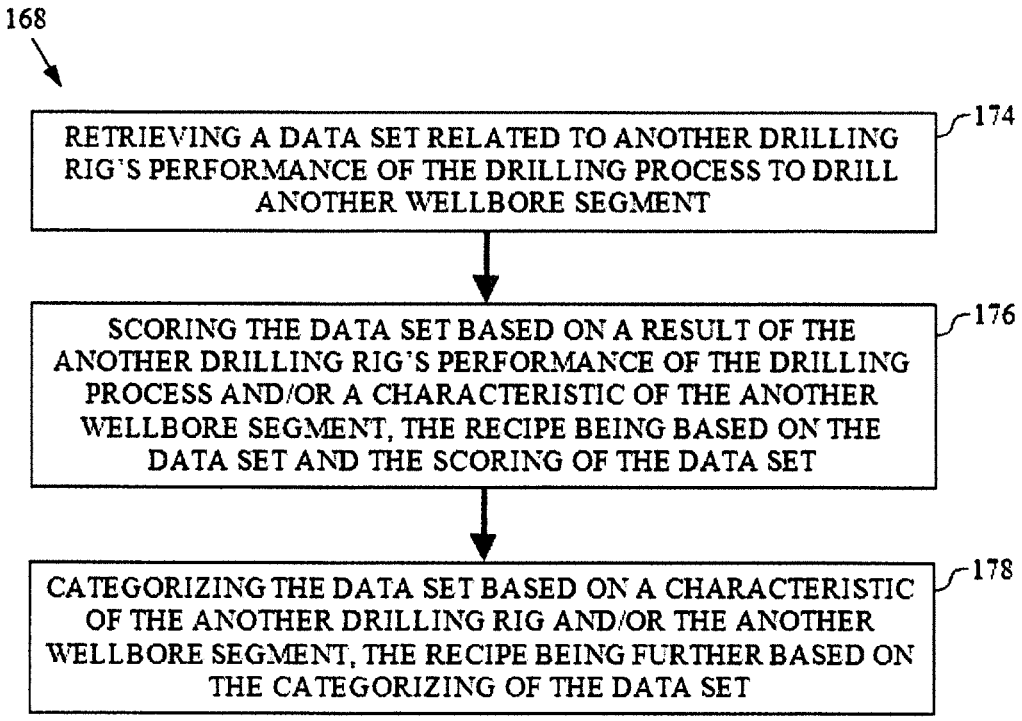
FIG. 11(*a*) is a flow diagram illustrating a step of the method of FIG. 10, according to one or more embodiments of the present disclosure.
Figure 11B:
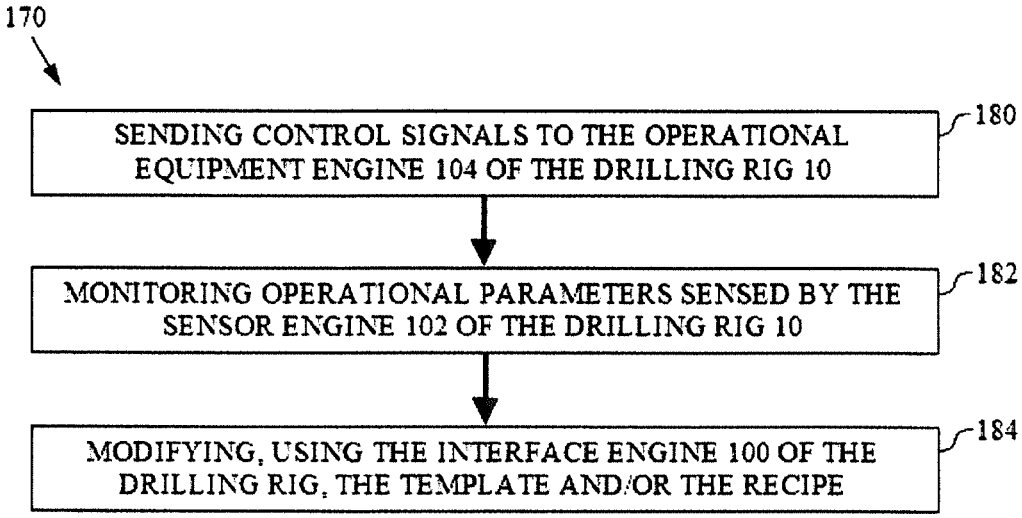

Turning to FIG. 11(*a*), in some embodiments, the step 168 of generating the recipe includes at least one of the following sub-steps: retrieving a data set related to another drilling rig's performance of the drilling process to drill another wellbore segment at a step 174, scoring the data set based on a result of the another drilling rig's performance of the drilling process and/or a characteristic of the another wellbore segment, the recipe being based on the data set and the scoring of the data set at a step 176, and categorizing the data set based on a characteristic of the another drilling rig and/or the another wellbore segment, the recipe being further based on the categorizing of the data set at a step 178. In some embodiments, the characteristic of the another drilling rig and/or the another wellbore segment that forms the basis on which the data set is categorized includes at least one of: a depth of the another wellbore segment, a geological layer through which the another wellbore segment extends, a geographic location of the another drilling rig, or a rig type of the another drilling rig.

Turning to FIG. 11(*b*), in some embodiments, the step 170 of performing, based on the template and the recipe, the drilling process with the drilling rig (e.g., 10) includes at least one of the following sub-steps: sending control signals to the operational equipment engine 104 of the drilling rig 10 at a step 180, monitoring operational parameters sensed by the sensor engine 102 of the drilling rig 10 at a step 182, modifying, using the interface engine 100 of the drilling rig, the template and/or the recipe at a step 184.

Figure 12:
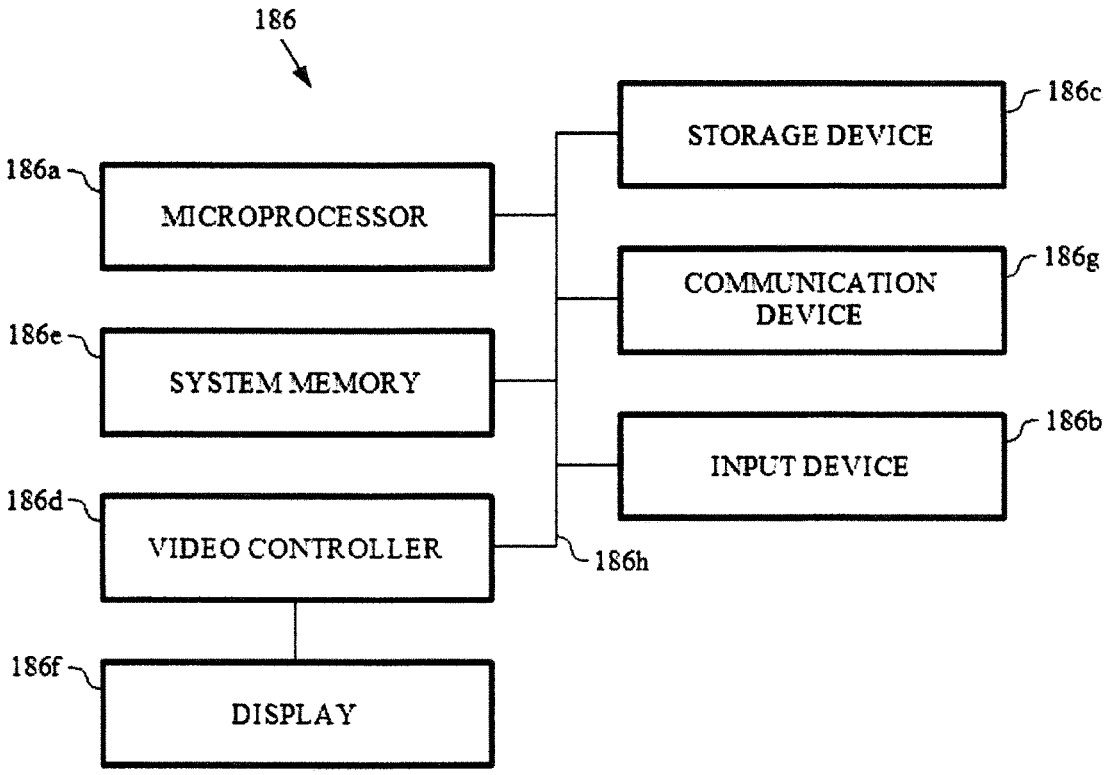
FIG. 12 is a diagrammatic illustration of a computing device for implementing one or more embodiments of the present disclosure.

Referring to FIG. 12, an embodiment of a computing device 186 for implementing one or more embodiments of one or more of the above-described controllers (e.g., 58, 90, 92, or 94), control systems (e.g., 50 or 96), computer systems (e.g., 98), methods (e.g., 164), and/or steps (e.g., 166, 168, 170, 172, 174, 176, 178, 180, 182, or 184), and/or any combination thereof, is depicted. The computing device 186 includes a microprocessor 186*a*, an input device 186*b*, a storage device 186*c*, a video controller 186*d*, a system memory 186*e*, a display 186*f*, and a communication device 186*g* all interconnected by one or more buses 186*h*. In some embodiments, the storage device 186*c* may include a floppy drive, hard drive, CD-ROM, optical drive, any other form of storage device and/or any combination thereof. In some embodiments, the storage device 186*c* may include, and/or be capable of receiving, a floppy disk, CD-ROM, DVD-ROM, or any other form of computer-readable medium that may contain executable instructions. In some embodiments, the communication device 186*g* may include a modem, network card, or any other device to enable the computing device to communicate with other computing devices. In some embodiments, any computing device represents a plurality of interconnected (whether by intranet or Internet) computer systems, including without limitation, personal computers, mainframes, PDAs, smartphones and cell phones.

The computing device can send a network message using proprietary protocol instructions to render 3D models and/or medical data. The link between the computing device and the display unit and the synchronization between the programmed state of physical manikin and the rendering data/3D model on the display unit of the present invention facilitate enhanced learning experiences for users. In this regard, multiple display units can be used simultaneously by multiple users to show the same 3D models/data from different points of view of the same manikin(s) to facilitate uniform teaching and learning, including team training aspects.

In some embodiments, one or more of the components of the above-described embodiments include at least the computing device 186 and/or components thereof, and/or one or more computing devices that are substantially similar to the computing device 186 and/or components thereof. In some embodiments, one or more of the above-described components of the computing device 186 include respective pluralities of same components.

In some embodiments, a computer system typically includes at least hardware capable of executing machine readable instructions, as well as the software for executing acts (typically machine-readable instructions) that produce a desired result. In some embodiments, a computer system may include hybrids of hardware and software, as well as computer sub-systems.

In some embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In some embodiments, hardware may include any physical device that is capable of storing machine-readable instructions, such as memory or other data storage devices. In some embodiments, other forms of hardware include hardware sub-systems, including transfer devices such as modems, modem cards, ports, and port cards, for example.

In some embodiments, software includes any machine code stored in any memory medium, such as RAM or ROM, and machine code stored on other devices (such as floppy disks, flash memory, or a CD ROM, for example). In some embodiments, software may include source or object code. In some embodiments, software encompasses any set of instructions capable of being executed on a computing device such as, for example, on a client machine or server.

In some embodiments, combinations of software and hardware could also be used for providing enhanced functionality and performance for certain embodiments of the present disclosure. In an embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In some embodiments, computer readable mediums include, for example, passive data storage, such as a random access memory (RAM) as well as semi-permanent data storage such as a compact disk read only memory (CD-ROM). One or more embodiments of the present disclosure may be embodied in the RAM of a computer to transform a standard computer into a new specific computing machine. In some embodiments, data structures are defined organizations of data that may enable an embodiment of the present disclosure. In an embodiment, a data structure may provide an organization of data, or an organization of executable code.

In some embodiments, any networks and/or one or more portions thereof, may be designed to work on any specific architecture. In an embodiment, one or more portions of any networks may be executed on a single computer, local area networks, client-server networks, wide area networks, internets, hand-held and other portable and wireless devices and networks.

In some embodiments, a database may be any standard or proprietary database software. In some embodiments, the database may have fields, records, data, and other database elements that may be associated through database specific software. In some embodiments, data may be mapped. In some embodiments, mapping is the process of associating one data entry with another data entry. In an embodiment, the data contained in the location of a character file can be mapped to a field in a second table. In some embodiments, the physical location of the database is not limiting, and the database may be distributed. In an embodiment, the database may exist remotely from the server, and run on a separate platform. In an embodiment, the database may be accessible across the Internet. In some embodiments, more than one database may be implemented.

In some embodiments, a plurality of instructions stored on a non-transitory computer readable medium may be executed by one or more processors to cause the one or more processors to carry out or implement in whole or in part the above-described operation of each of the above-described embodiments of the drilling rig 10, the apparatus 54, the computer system 98, the interface engine 100, the sensor engine 102, the operational equipment engine 104, the automated sequence engine 106, the sequence template module 108, and/or the recipe learning module 110, and/or any combination thereof. In some embodiments, such a processor may include the microprocessor 186*a*, and such a non-transitory computer readable medium may include the storage device 186*c*, the system memory 186*e*, or a combination thereof. Moreover, the computer readable medium may be distributed among one or more components of the drilling rig 10, the apparatus 54, the computer system 98, the interface engine 100, the sensor engine 102, the operational equipment engine 104, the automated sequence engine 106, the sequence template module 108, and/or the recipe learning module 110, and/or any combination thereof. In some embodiments, such a processor may execute the plurality of instructions in connection with a virtual computer system. In some embodiments, such a plurality of instructions may communicate directly with the one or more processors, and/or may interact with one or more operating systems, middleware, firmware, other applications, and/or any combination thereof, to cause the one or more processors to execute the instructions.

The present disclosure introduces a method including providing, using a computing device, a template that includes a plurality of data fields outlining operational steps and associated parameters to perform a drilling process; generating a recipe for entry into the data fields of the template, wherein generating the recipe includes retrieving, using the computing device, a data set related to a first drilling rig's performance of the drilling process to drill a first wellbore segment, and scoring, using the computing device, the data set based on a result of the first drilling rig's performance of the drilling process and/or a characteristic of the first wellbore segment, the recipe being based on the data set and the scoring of the data set; and performing, based on the template and the recipe, the drilling process with a second drilling rig to drill a second wellbore segment. In some embodiments, either: the first and second wellbore segments are part of the same wellbore and the first and second drilling rigs are the same drilling rig; or the first and second wellbore segments are part of different wellbores and the first and second drilling rigs are different drilling rigs. In some embodiments, generating the recipe further includes categorizing, using the computing device, the data set based on a characteristic of the first drilling rig and/or the first wellbore segment, the recipe being further based on the categorizing of the data set. In some embodiments, the characteristic of the first drilling rig and/or the first wellbore segment that forms the basis on which the data set is categorized includes at least one of: a depth of the first wellbore segment; a geological layer through which the first wellbore segment extends; a geographic location of the first drilling rig; or a rig type of the first drilling rig. In some embodiments, the method further includes automatically entering, using the computing device, the recipe into the data fields of the template. In some embodiments, performing, based on the template and the recipe, the drilling process with the second drilling rig includes sending, using the computing device, control signals to an operational equipment engine of the second drilling rig; and monitoring, using the computing device, operational parameters sensed by a sensor engine of the second drilling rig. In some embodiments, performing, based on the template and the recipe, the drilling process with the second drilling rig includes modifying, using an interface engine of the second drilling rig, the template and/or the recipe.

The present disclosure also introduces an apparatus including a non-transitory computer readable medium; and a plurality of instructions stored on the non-transitory computer readable medium and executable by one or more processors, the plurality of instructions including: instructions that cause the one or more processors to provide a template that includes a plurality of data fields outlining operational steps and associated parameters to perform a drilling process; instructions that cause the one or more processors to generate a recipe for entry into the data fields of the template, the instructions that cause the one or more processors to generate the recipe including instructions that cause the one or more processors to: retrieve a data set related to a first drilling rig's performance of the drilling process to drill a first wellbore segment, and score the data set based on a result of the first drilling rig's performance of the drilling process and/or a characteristic of the first wellbore segment, the recipe being based on the data set and the scoring of the data set; and instructions that cause the one or more processors to control, based on the template and the recipe, a second drilling rig's performance of the drilling process to drill a second wellbore segment. In some embodiments, either: the first and second wellbore segments are part of the same wellbore and the first and second drilling rigs are the same drilling rig; or the first and second wellbore segments are part of different wellbores and the first and second drilling rigs are different drilling rigs. In some embodiments, the instructions that cause the one or more processors to generate the recipe further include instructions that cause the one or more processors to categorize the data set based on a characteristic of the first drilling rig and/or the first wellbore segment, the recipe being further based on the categorizing of the data set. In some embodiments, the characteristic of the first drilling rig and/or the first wellbore segment that forms the basis on which the data set is categorized includes at least one of: a depth of the first wellbore segment; a geological layer through which the first wellbore segment extends; a geographic location of the first drilling rig; or a rig type of the first drilling rig. In some embodiments, the plurality of instructions further include instructions that cause the one or more processors to automatically enter the recipe into the data fields of the template. In some embodiments, the instructions that cause the one or more processors to control, based on the template and the recipe, the second drilling rig's performance of the drilling process include instructions that cause the one or more processors to send control signals to an operational equipment engine of the second drilling rig; and instructions that cause the one or more processors to monitor operational parameters sensed by a sensor engine of the second drilling rig. In some embodiments, the instructions that cause the one or more processors to control, based on the template and the recipe, the second drilling rig's performance of the drilling process include instructions that cause the one or more processors to permit modification, via an interface engine of the second drilling rig, of the template and/or the recipe.

The present disclosure also introduces a rig control system including an automated sequence engine including a sequence template module configured to provide a template that includes a plurality of data fields outlining operational steps and associated parameters to perform a drilling process, and a recipe learning module configured to generate a recipe for entry into the data fields of the template; an operational equipment engine configured to perform the drilling process to drill a first wellbore segment; a computer system in communication with the automated sequence engine and the operational equipment engine, the computer system being configured to send control signals, based on the template and the recipe, to the operational equipment engine so that the operational equipment engine performs the drilling process to drill the first wellbore segment; wherein, to generate the recipe, the recipe learning module is configured to retrieve a data set related to a drilling rig's performance of the drilling process to drill a second wellbore segment, and to score the data set based on a result of the drilling rig's performance of the drilling process and/or a characteristic of the second wellbore segment, the recipe being based on the data set and the scoring of the data set. In some embodiments, either: the first and second wellbore segments are part of the same wellbore; or the first and second wellbore segments are part of different wellbores. In some embodiments, to generate the recipe, the recipe learning module is further configured to categorize the data set based on a characteristic of the drilling rig and/or the second wellbore segment, the recipe being further based on the categorizing of the data set. In some embodiments, the characteristic of the drilling rig and/or the second wellbore segment that forms the basis on which the data set is categorized includes at least one of: a depth of the second wellbore segment; a geological layer through which the second wellbore segment extends; a geographic location of the drilling rig; or a rig type of the drilling rig. In some embodiments, the computer system automatically enters the recipe into the data fields of the template. In some embodiments, the rig control system further includes a sensor engine in communication with the computer system and configured to monitor the performance of the drilling process by the operational equipment engine; and an interface engine in communication with the computer system and to permit a user's modification of the template and/or the recipe.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method, comprising:

providing, using a computing device, a template that includes a plurality of data fields outlining operational steps and associated parameters to perform a drilling process;

generating a recipe for entry into the data fields of the template, wherein generating the recipe comprises retrieving, using the computing device, a data set related to a first drilling rig performing the drilling process to drill a first wellbore segment, and scoring, using the computing device, the data set based on a result of the first drilling rig performing the drilling process and/or a characteristic of the first wellbore segment, the recipe being based on the data set and the scoring of the data set; and performing, based on the template and the recipe, the drilling process with a second drilling rig to drill a second wellbore segment.

2. The method of claim 1, wherein either:

the first and second wellbore segments are part of the same wellbore and the first and second drilling rigs are the same drilling rig; or the first and second wellbore segments are part of different wellbores and the first and second drilling rigs are different drilling rigs.

3. The method of claim 1, wherein generating the recipe further comprises categorizing, using the computing device, the data set based on a characteristic of the first drilling rig and/or the first wellbore segment, the recipe being further based on the categorizing of the data set.

4. The method of claim 3, wherein the characteristic of the first drilling rig and/or the first wellbore segment that forms the basis on which the data set is categorized comprises at least one of:

a depth of the first wellbore segment;

a geological layer through which the first wellbore segment extends;

a geographic location of the first drilling rig; or a rig type of the first drilling rig.

5. The method of claim 1, further comprising automatically entering, using the computing device, the recipe into the data fields of the template.

6. The method of claim 1, wherein performing, based on the template and the recipe, the drilling process with the second drilling rig comprises:

sending, using the computing device, control signals to an operational equipment engine of the second drilling rig; and monitoring, using the computing device, operational parameters sensed by a sensor engine of the second drilling rig.

7. The method of claim 1, wherein performing, based on the template and the recipe, the drilling process with the second drilling rig comprises modifying, using an interface engine of the second drilling rig, the template and/or the recipe.

8. An apparatus, comprising:

a non-transitory computer readable medium; and a plurality of instructions stored on the non-transitory computer readable medium and executable by one or more processors, the plurality of instructions comprising:

instructions that cause the one or more processors to provide a template that includes a plurality of data fields outlining operational steps and associated parameters to perform a drilling process;

instructions that cause the one or more processors to generate a recipe for entry into the data fields of the template, the instructions that cause the one or more processors to generate the recipe comprising instructions that cause the one or more processors to: retrieve a data set related to a first drilling rig performing the drilling process to drill a first wellbore segment, and score the data set based on a result of the first drilling rig performing the drilling process and/or a characteristic of the first wellbore segment, the recipe being based on the data set and the scoring of the data set; and instructions that cause the one or more processors to generate control signals that control, based on the template and the recipe, a second drilling rig performing the drilling process to drill a second wellbore segment.

9. The apparatus of claim 8, comprising an operational equipment engine on the second drilling rig that performs a drilling process based on the generated control signal.

10. The apparatus of claim 8, wherein either:

the first and second wellbore segments are part of the same wellbore and the first and second drilling rigs are the same drilling rig; or the first and second wellbore segments are part of different wellbores and the first and second drilling rigs are different drilling rigs.

11. The apparatus of claim 8, wherein the instructions that cause the one or more processors to generate the recipe further comprise instructions that cause the one or more processors to categorize the data set based on a characteristic of the first drilling rig and/or the first wellbore segment, the recipe being further based on the categorizing of the data set.

12. The apparatus of claim 11, wherein the characteristic of the first drilling rig and/or the first wellbore segment that forms the basis on which the data set is categorized comprises at least one of:

a depth of the first wellbore segment;

a geological layer through which the first wellbore segment extends;

a geographic location of the first drilling rig; or a rig type of the first drilling rig.

13. The apparatus of claim 8, wherein the plurality of instructions further comprise instructions that cause the one or more processors to automatically enter the recipe into the data fields of the template.

14. The apparatus of claim 8, wherein the instructions that cause the one or more processors to control, based on the template and the recipe, the second drilling rig performing the drilling process comprise:

instructions that cause the one or more processors to send control signals to an operational equipment engine of the second drilling rig; and instructions that cause the one or more processors to monitor operational parameters sensed by a sensor engine of the second drilling rig.

15. The apparatus of claim 8, wherein the instructions that cause the one or more processors to control, based on the template and the recipe, the second drilling rig performing the drilling process comprise instructions that cause the one or more processors to permit modification, via an interface engine of the second drilling rig, of the template and/or the recipe.

16. A rig control system, comprising:

an automated sequence engine comprising a sequence template module configured to provide a template that includes a plurality of data fields outlining operational steps and associated parameters to perform a drilling process, and a recipe learning module configured to generate a recipe for entry into the data fields of the template;

an operational equipment engine configured to perform the drilling process to drill a first wellbore segment;

a computer system in communication with the automated sequence engine and the operational equipment engine, the computer system being configured to send control signals, based on the template and the recipe, to the operational equipment engine so that the operational equipment engine performs the drilling process to drill the first wellbore segment;

wherein, to generate the recipe, the recipe learning module is configured to retrieve a data set related to a drilling rig performing the drilling process to drill a second wellbore segment, and to score the data set based on a result of the drilling rig performing the drilling process and/or a characteristic of the second wellbore segment, the recipe being based on the data set and the scoring of the data set.

17. The rig control system of claim 16, wherein either:

the first and second wellbore segments are part of the same wellbore; or the first and second wellbore segments are part of different wellbores.

18. The rig control system of claim 16, wherein, to generate the recipe, the recipe learning module is further configured to categorize the data set based on a characteristic of the drilling rig and/or the second wellbore segment, the recipe being further based on the categorizing of the data set.

19. The rig control system of claim 16, wherein the characteristic of the drilling rig and/or the second wellbore segment that forms the basis on which the data set is categorized comprises at least one of:

a depth of the second wellbore segment;

a geological layer through which the second wellbore segment extends;

a geographic location of the drilling rig; or a rig type of the drilling rig.

20. The rig control system of claim 16, wherein the computer system automatically enters the recipe into the data fields of the template.

21. The rig control system of claim 16, further comprising:

a sensor engine in communication with the computer system and configured to monitor the performance of the drilling process by the operational equipment engine; and an interface engine in communication with the computer system and to permit a user's modification of the template and/or the recipe.

* * * * *